US007563968B2

(12) United States Patent
Medas

(10) Patent No.: US 7,563,968 B2
(45) Date of Patent: Jul. 21, 2009

(54) BRIDGE SYSTEM FOR IMPROVED ACOUSTIC COUPLING IN STRINGED INSTRUMENTS

(75) Inventor: Brian Medas, Midlothian, VA (US)

(73) Assignee: Medas Instruments, Inc., Richmond, VA (US)

( * ) Notice: Subject to any disclaimer, the term of this patent is extended or adjusted under 35 U.S.C. 154(b) by 0 days.

(21) Appl. No.: 11/837,401

(22) Filed: Aug. 10, 2007

(65) Prior Publication Data

US 2008/0034940 A1 Feb. 14, 2008

Related U.S. Application Data

(60) Provisional application No. 60/836,699, filed on Aug. 10, 2006.

(51) Int. Cl.
*G10D 3/04* (2006.01)

(52) U.S. Cl. ..... 84/298; 84/299

(58) Field of Classification Search ..... 84/298, 84/299

See application file for complete search history.

(56) References Cited

U.S. PATENT DOCUMENTS

| | | | | |
|---|---|---|---|---|
| 4,311,078 | A * | 1/1982 | Falgares | 84/314 R |
| 4,385,543 | A * | 5/1983 | Shaw et al. | 84/298 |
| 4,538,498 | A * | 9/1985 | Marten | 84/298 |
| 5,448,935 | A * | 9/1995 | Kosinar | 84/298 |
| 5,539,143 | A * | 7/1996 | Rose | 84/298 |
| 5,600,078 | A * | 2/1997 | Edwards | 84/307 |
| 6,031,165 | A * | 2/2000 | Brekke | 84/298 |
| 6,133,515 | A * | 10/2000 | Hoshino | 84/307 |
| 6,137,039 | A * | 10/2000 | Rose | 84/298 |
| 6,297,434 | B1 * | 10/2001 | Martello | 84/298 |
| 6,521,819 | B1 * | 2/2003 | Di Iorio | 84/298 |
| 7,326,839 | B2 * | 2/2008 | Kinoshita | 84/298 |
| 7,327,109 | B1 * | 2/2008 | Hagen | 318/298 |
| 2002/0092404 | A1 * | 7/2002 | Naimish | 84/298 |
| 2007/0095192 | A1 * | 5/2007 | Moore | 84/298 |
| 2007/0289429 | A1 * | 12/2007 | Tyler | 84/297 R |
| 2008/0034940 | A1 * | 2/2008 | Medas | 84/298 |

* cited by examiner

*Primary Examiner*—Jeffrey Donels
*Assistant Examiner*—Robert W Horn
(74) *Attorney, Agent, or Firm*—Greenberg Traurig LLP

(57) ABSTRACT

A bridge system for connection to the instrument body of a stringed instrument, the bridge system including at least one bridge piece configured to contact at least one string of the stringed instrument and a ramp-shaped height and tone adjustment bar between the bridge piece and the instrument body. An adjustment mechanism translates the height and tone adjustment bar with respect to the bridge piece to raise and lower the string and to provide contact between the bridge piece and the instrument body.

15 Claims, 4 Drawing Sheets

BRIDGE SYSTEM FOR IMPROVED ACOUSTIC COUPLING IN STRINGED INSTRUMENTS

This is a non-provisional patent application claiming priority to U.S. Provisional Patent Application No. 60/836,699 filed Aug. 10, 2006, the entire disclosure of which is incorporated herein by reference.

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates in general to the field of fretted or stringed instruments, and in particular to a novel bridge system for providing improved acoustic coupling in such instruments.

BACKGROUND OF THE INVENTION

Stringed instruments, particularly electric and acoustic guitars, typically require a bridge on the body of the instrument to lift the strings so that an appropriate gap exists between the strings and the fretboard or fingerboard of the instrument. Bridges that are utilized on electric guitars are often adjustable in height such that this gap, or "action," can be set to provide a desired tone and/or feel when the strings are depressed onto the fretboard by the player's fingers. Such bridges typically also provide adjustment of the intonation or position of the bridge or bridge piece(s). Bridges further function to transfer the vibrations of the instrument's string(s) to the body of the instrument, thus causing resonation of the instrument body and increasing resonation of the strings.

The past several decades have seen minimal changes and improvements in the basic design of the bridge. Generally, the height of the string(s) has been adjusted using two approaches. The first is the tune-o-matic type bridge design. In this design the strings rest on an object commonly called a bridge assembly. The bridge assembly rests on two threaded poles or posts, one at each end of the bridge assembly. These poles or posts are mounted into a threaded base. The poles or posts can be raised or lowered by turning their threaded shafts, thus raising or lowering them in much the same manner as screwing a screw into or out of a piece of wood. Turning the threaded shaft to the right causes it to recede down into the threaded base, and turning the threaded shaft to the left causes it to rise up out of the threaded base.

Another version of the tune-o-matic bridge has the threaded poles or posts secured in a fixed position. Each pole or post has a threaded wheel which is free to turn. The bridge assembly sits upon these two wheels. Again a right turning of the wheel raises it up the threaded pole or post, thus causing the bridge assembly to rise with the wheel upon which it sits, and a left turning of the wheel lowers it down the treaded pole or post, thus lowering the bridge assembly along with the wheel.

Another approach to adjusting the height of the strings is used in hard-tail or fixed bridges and tremolo bridges. Both of these bridge designs typically have a bridge plate securely mounted to the instrument body and individual bridge pieces attached to a bridge body upon which the strings rest. These bridge pieces are secured to the bridge plate with an adjustment screw or bolt. The function of that screw or bolt will be described in further detail below. The bridge piece(s) typically have two threaded holes in them. These two threaded holes accept two threaded screws, sometimes called feet. As in the tune-o-matic bridge example described above, turning the threaded screw or feet to the right raises the bridge piece up and turning it to the left lowers the bridge down.

Adjustment of intonation on stringed instruments, particularly electric guitars, is typically performed by adjusting the position of the bridge piece(s) along the axis that is parallel to the strings. In most bridge designs this is done by moving individual bridge piece(s) forwards or backwards by turning a screw or bolt which is attached to the individual bridge piece. The screw or bolt is anchored to the bridge plate through a hole in the rear of the bridge plate. The bridge piece is often held in place with tension between the bridge piece and bridge plate provided by a spring wrapped around the above adjustment screw or bolt. Again the bridge piece has a threaded hole that accepts the threaded screw. As the screw is turned to the right the bridge piece moves down the string length and towards the end of the bridge plate. As the screw is turned to the left the bridge piece moves up the string length and away from the end of the bridge plate.

Transfer of the vibrations of the string to the body of the instrument is accomplished via contact of the string with the bridge or bridge pieces, which then make contact with their poles, posts, or adjustable screws or feet, which in turn make contact with the body of the instrument.

The bridge design, its materials, and amount of contact surface of those materials, are important factors in providing the musician with feedback or "feel" of the instrument. This in turn affects the ability of the musician to communicate his expression and interpretation of music written for the instrument. Prior bridge designs that use adjustment feet and adjustment studs for purposes of raising and lowering strings cause a tremendous loss of vibration transference from string to bridge to instrument body.

OBJECTS AND SUMMARY OF THE INVENTION

It is therefore an object of the invention to provide an improved bridge design for fretted and other stringed instruments.

In a preferred embodiment, the invention provides a bridge system for connection to the instrument body of a stringed instrument, the bridge system including at least one bridge piece configured to contact at least one string of the stringed instrument and a ramp-shaped height and tone adjustment bar between the bridge piece and the instrument body. An adjustment mechanism translates the height and tone adjustment bar with respect to the bridge piece to raise and lower the string and to provide contact between the bridge piece and the instrument body.

In a preferred embodiment, the height and tone adjustment bar of the present invention provides both the functions of raising and lowering the strings and conducting vibrations of the string from the bridge piece to the instrument body. This not only provides for a fuller, richer sound, but also gives the musician a solid feeling when playing the instrument.

The tone of the sound produced by the instrument may be modified by changing the material from which the height and tone adjustment bar is constructed. The materials in which the bridge plate, bridge piece(s) poles and posts are constructed, and the amount of surface of the bridge piece(s) that comes into contact with the body of the instrument, affects the volume of vibrations, the sustain of the vibrations, the clarity of the vibrations, and the tone of the vibrations transferred to the body of the instrument.

The invention in certain embodiments is provided in the form of a replacement bridge which has a form factor that facilitates its use as a replacement for one of several common stock bridges.

The invention provides the musician with a bridge that functions far better than bridges of the prior art and offers a wider range of tone and sound to choose from, thus expanding their ability to express and interrupt the music written for the instrument.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION OF THE PREFERRED EMBODIMENT

Reference will now be made in detail to the preferred embodiments of the present invention, examples of which are illustrated in the accompanying drawings.

Figure 1:
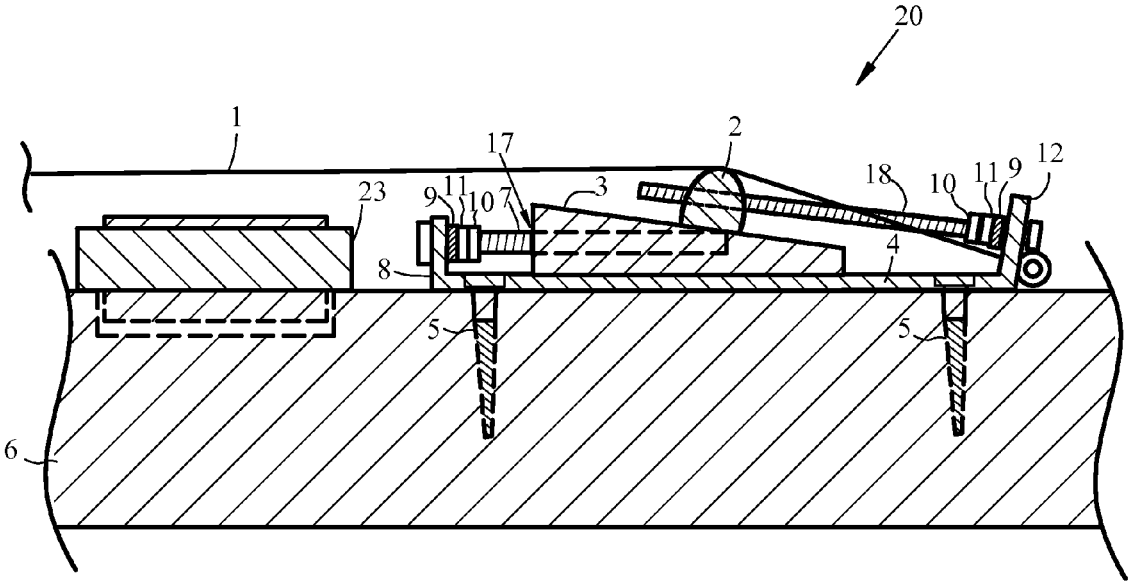
FIG. 1 is a side elevational view illustrating an embodiment of the bridge system, mounted on a stringed instrument.
Figure 2:
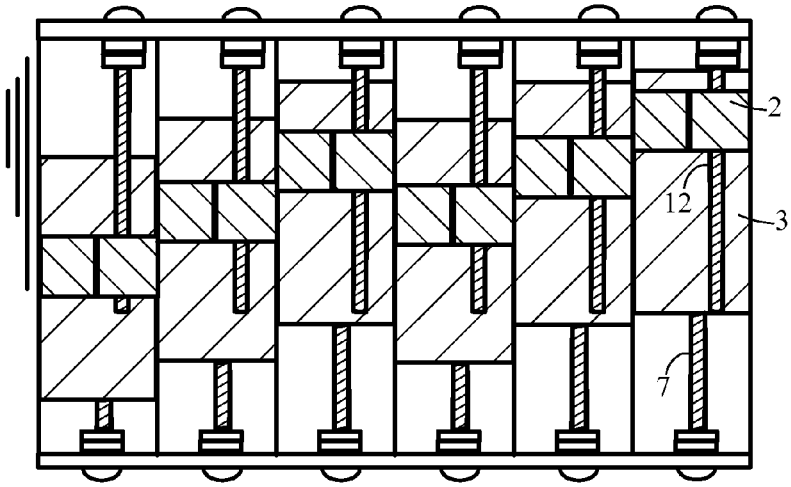
FIG. 2 is a top view of the bridge system of the invention in accordance with one embodiment thereof.

With reference to FIGS. 1 and 2, a bridge system 20 in accordance with an embodiment of the invention is mounted upon a body 6 of a stringed instrument, such as an electric or acoustic guitar. In the case of an electric guitar, the bridge system 20 may be mounted behind a pickup 23. A string or strings 1 is set into vibrating motion by the picking, plucking, hammering, or other action by a player. One end of the string (s) rests on a surface generally known as a nut, not shown. At its other end the string rests upon a bridge saddle or bridge piece(s) 2. The vibrations of the string(s) are transferred to the bridge piece(s) 2. The bridge piece(s) 2 fully rest upon height and tone adjustment bar(s) 3. The vibrations generated by the string(s) 1 that were transferred to the bridge piece(s) 2 are then transferred to the height and tone adjustment bar(s) 3. The height and tone adjustment bar(s) 3 have a recess 17, which may include a metal cylinder, for receiving a bolt 7 that is used for height and tone adjustment.

The type of material selected for the bridge piece(s) 2 and the height and tone adjustment bar(s) 3 has an affect on the volume, tone color, and sustain of the vibrations that originated from the string(s) 1. Such materials may comprise, e.g., metal, lead, copper, graphite, solid surface materials such as Corian™, thermosetting plastics, animal bone, various types of wood, and polymers. The affect that these materials have on the vibrations that come into contact with them would be described as being tone colors of a bright or bell-like tone (from metal) to a dark, or warm tone (from plastic).

The sustain or duration of the vibrations that originate from the string(s) 1 is also affected by the materials used in the bridge piece(s) 2 and the height and tone adjustment bar(s) 3. Generally, the softer the material, the shorter the string vibration and duration will be.

The purpose of providing a choice of different materials is to give the musician several added options in his/her process of producing the type of sound and sustain he/she is looking for. In bridges of the prior art there is a very limited variation on materials used, and the parts typically do not have full contact with one another for various reasons, thus limiting the tone and sustain capabilities and options.

The height and tone adjustment bar(s) fully rest upon the bridge base plate 4, with a substantial amount of surface area contact between the bridge base plate and each of the height and tone adjustment bars. In one embodiment, such substantial amount of surface area contact is at least 0.6 $cm^2$. In the case of a single height and tone adjustment bar for all six strings of a guitar, for example, at least 3.6 $cm^2$ of surface area contact may be provided between the bridge base plate and the height and tone adjustment bar. The vibrations that were transferred to the height and tone adjustment bar 3 are transferred to the bridge base plate 4.

Figure 3:
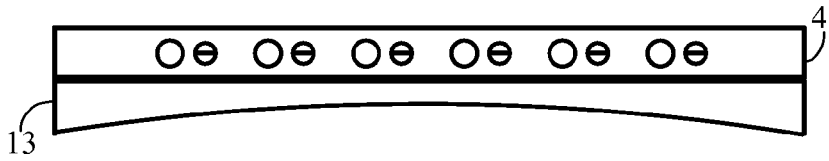
FIGS. 3 and 4 show rear views of the bridge system, along with first and second embodiments of a spacer for making contact between the base plate and an archtop instrument.
Figure 4:
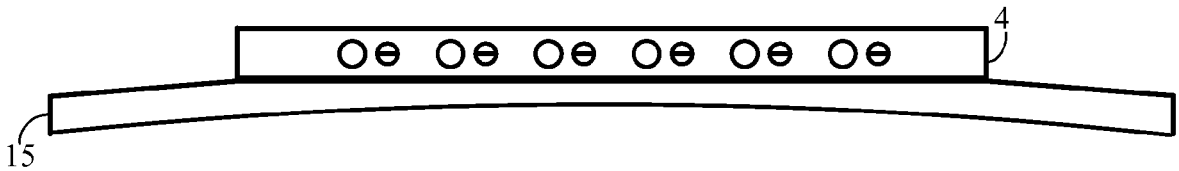

FIGS. 3 and 4 show rear views of the bridge system, along with first and second embodiments of a spacer for making contact between the base plate 4 and the curved body of an archtop instrument. For an archtop hollowbody replacement bridge, a spacer 13 may be provided. For an archtop solid body electric guitar replacement bridge, a spacer 15 may be provided. With respect to both of these parts, the string vibrations are transferred to them from the bridge base plate 4 and the type of material from which the spacers 13, 15 are made have an effect upon both the tone and sustain of the instrument.

With continued reference to FIGS. 1 and 2, the base bridge plate 4 in certain embodiments has solid direct contact with the body 6 of the instrument, and in other embodiments, such as the archtop embodiments discussed above, has solid indirect contact with the body 6 of the instrument. Because of their positions in relationship to the bridge plate 4, and in relationship to one another, the height and tone adjustment bar 3, the bridge piece 2 and the string 1 all come into solid indirect contact with the body 6 of the instrument.

The form of the body 6 of the instrument, and the various materials from which the body 6 can be constructed, has an effect on the tone and sustain of the vibrations that originated from the string 1.

For purposes of strength and durability the bridge base plate 4 is preferably constructed from metal, but other suitable materials may be used without departing from the spirit and scope of the invention. The bridge base plate 4 provides the structure of the bridge parts assembly and allows for the movement or adjustment of the positions of the tone and height adjustment bar(s) 3 and the bridge piece(s) 2.

The shape of the height and tone adjustment bar 3 is important to its function of raising and lowering the string(s) 1. The height and tone adjustment bar 3 is higher at it's end that includes recess 17 for accepting the height and tone adjustment bolt 7. In one embodiment, it is approximately 0.25 inches high at that end, and approximately 0.08 inches high at its opposite end. This creates a slope of approximately 3 degrees. It's surface is smooth, allowing the bridge piece 2, which sits upon it, the ability to slide up and down the surface when moved or adjusted. The translational movement of the height and tone adjustment bar 3 may be used to adjust the height of the string up or down or up and away from the instrument body 6 or down towards the instrument body 6. This may be necessary to accommodate the various structures of each unique instrument so that the strings can vibrate clearly without being obstructed by any part of the instrument when the string is played open. It may also be necessary to accommodate the feel and "action" of the string, which is determined by it's height from the instrument, which becomes a factor as the musician presses down the string or stops the string on the fretboard or fingerboard.

The movement of the height and string adjustment bar 3 is accomplished by the following design. The height and tone adjustment bolt 7 is a threaded bolt fed through a hole in the bridge base plate forward lip 8. This bolt has a head that may be a flat head or a phillips head that will accept a tool for the purpose of turning the bolt 7. Just inside the base plate forward lip 8 there is a washer 9 made from a soft material such as, but not limited to, felt or rubber placed around the height and tone adjustment bolt 7. This washer 9 comes into contact with the base bridge plate forward lip 8 for height adjustment. It's purpose is to provide a cushion and limited amount of movement of the height and tone adjustment bolt 7 and to eliminate the possibility of any unwanted sympathetic vibrations from the bridge base plate forward lip 8 for height adjustment and nut 10 touching one another, or barely touching one another, while the string is vibrating. Next on the height and tone adjustment bolt are two nuts 10, 11. These two nuts are placed on the bolt 7 close to the base plate lip 8 for height adjustment while still allowing the bolt to freely turn.

Tightening the two nuts 10, 11 against each other causes them to lock one another in place such that they are unable to move up and down the bolt 7. This function can also be achieved and used in this design by the use of a spring encircling the bolt 7 in the area between the bridge base plate lip 8 and the height and tone adjustment bar 3. However, in a preferred embodiment, the nut 10 against nut 11 design for it eliminates the possibility of the spring developing sympathetic vibrations during the string vibration action. The height and tone adjustment bar 3 has a threaded hole in it's side. This hole is in line with the position of the height and tone adjustment bolt 7. These threads will accept the threads of the height and tone adjustment bolt 7. In bridge models where the height and tone adjustment bar(s) 3 are made from a material other than metal this hole may have a metal cylinder 16 glued inside the hole. The metal cylinder 16 is threaded to accept the height and tone adjustment bolt 7. The bolt 7 is placed inside the threaded hole of the height and tone adjustment bar 3.

When the height and tone adjustment bolt 7 is turned the bar 3 will move. When the height and tone adjustment bolt is turned to the left or counter-clockwise the height and tone adjustment bar 3 will move in the direction towards the bridge base plate rear lip 12 for string and bridge piece adjustment. Because of the slope of the top surface of the height and tone adjustment bar the bridge piece 2 which is resting upon it will be raised up or away from the instrument body 6 thus the height of the string 1 will be raised as well.

When the height and tone adjustment bolt 7 is turned to the right or clockwise the height and tone adjustment bar will move towards the bridge base plate forward lip 8 for height adjustment. Because of the slope of the top of the height and tone adjustment bar 3 the bridge piece which is resting upon it will be lowered or move down towards the instrument body 6, thus the height of the string 1 will be lowered as well.

The movement or adjustment of the position of the bridge piece 2 is important. Its position effects the string's ability to sound in tune. It is used to adjust the instrument's intonation. In this bridge design attention has been given to the ability to adjust the bridge piece in whatever position is necessary for proper intonation. The movement of the bridge piece 2 is accomplished by the following design. The bridge piece adjustment bolt 18 is a threaded bolt fed through a hole in the bridge base plate rear lip 12. This bolt has a head that is either a flat head or a phillips head which will accept a tool for the purpose of turning the bridge piece adjustment bolt 18. Just inside the base plate rear lip 12 there is a washer 9 made from a soft material such as but not limited to felt or rubber placed around the bridge piece adjustment bolt 18. This washer 9 comes into contact with the base bridge plate rear lip 12. It's purpose is to provide a cushion and limited amount of movement of the bridge piece adjustment bolt 18 and to eliminate the possibility of any unwanted sympathetic vibrations from the bridge base plate rear lip 12 and nut 10 touching one another or barely touching one another during the string vibration action. Next on the bridge piece adjustment bolt 18 are two nuts 10*a*, 11*a*. These two nuts are placed on the bolt 18 close to the base plate rear lip 12 while allowing the bridge adjustment bolt 18 to turn freely.

By tightening the two nuts 10*a*, 11*a* against each other the nuts lock one another in place and are unable to move up and down the bridge piece adjustment bolt 18. This function can also be achieved and used in this design by the use of a spring encircling the bridge piece adjustment bolt 18 in the area between the bridge base plate rear lip 12 and the bridge piece 2. The nut 10*a* against nut 11*a* design is preferable for it eliminates the possibility of the spring vibrating and creating sympathetic vibrations during the string vibration action.

The bridge piece 2 has a threaded hole running through it. This hole runs horizontal and is in line with the position of the bridge piece adjustment bolt 18. These threads will accept the threads of the bridge piece adjustment bolt 18. The bridge models where the bridge piece(s) 2 are made from a material other than metal this hole will have a metal cylinder 16 glued inside the hole. The metal cylinder 16 is threaded to accept the bridge piece adjustment bolt 18. The bridge piece adjustment bolt 18 is placed inside the threaded hole of the bridge piece 2.

When the bridge piece bolt 18 is turned the bridge piece 2 will move. When the bridge piece adjustment bolt is turned to the left or "counter clockwise" the bridge piece 2 will move in the direction towards the bridge base plate forward lip 8. When the bridge piece adjustment bolt is turned to the right or "clockwise" the bridge piece 2 with move in the direction of the bridge base plate rear lip 12.

The bridge base plate and full bridge assembly can be attached to the body of an instrument in several ways.

Figure 5:
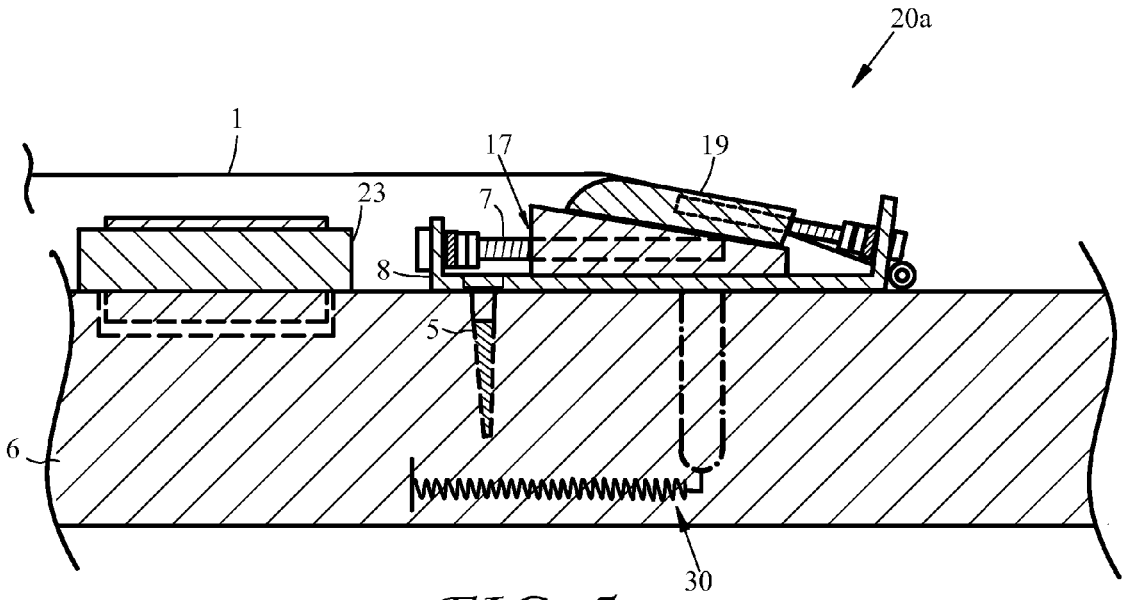
FIG. 5 shows a side elevational view illustrating a modern tremolo or fixed-bridge embodiment of a bridge system in accordance with the invention.

FIG. 5 shows a side elevational view illustrating a modern tremolo or fixed-bridge embodiment of a bridge system 20*a* in accordance with the invention. This embodiment utilizes a bridge piece 19 in place of a bridge piece 2 (FIG. 1). The bridge piece 2 design of FIG. 1, due to its smaller size, transfers the vibrations in a more direct and penetrating way producing a more focused sound. Also because of its small size it allows for a wider range of adjustment of its position for intonation. It also has the general appearance of many older, original or vintage bridge pieces.

The bridge pieces 19 of FIG. 5 have two functions. First they have a much larger and smoother surface. This is important for there are many musicians that, while playing their instrument, rest the palm of their plectrum hand on the bridge of the instrument. This bridge piece 19 provides a more comfortable surface on which to rest the palm. Secondly, the bridge piece 19 has a more smooth, or sleek, modern appearance. This embodiment may be used as a replacement bridge for all Fender modern style fixed bridges with or without a tremolo 30.

Figure 6:
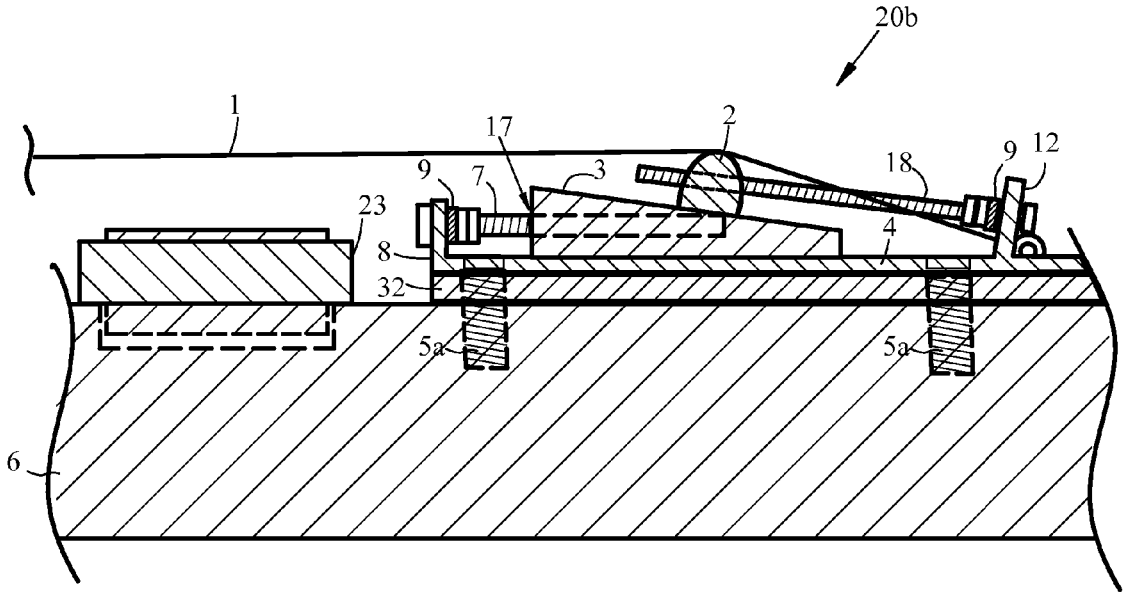
FIG. 6 shows a side elevational view illustrating a tune-o-matic style replacement bridge embodiment of a bridge system in accordance with the invention.

FIG. 6 shows a side elevational view illustrating a tune-o-matic style replacement bridge embodiment of a bridge system 20*b* in accordance with the invention. In accordance with this embodiment, bridge base plate 4 connects to bridge height adjustment bolts 5*a*. A spacer plate 32 may be provided between the body 6 of the instrument and the bridge base plate 4.

Figure 7:
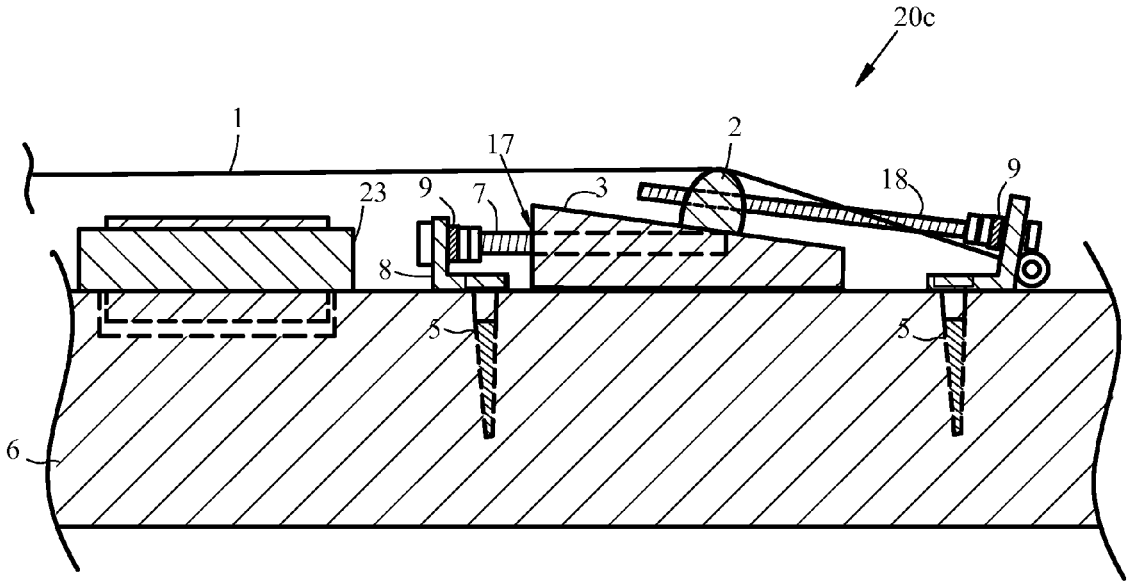
FIG. 7 shows a side elevational view illustrating an embodiment of the invention in which no bridge base plate is provided.

FIG. 7 shows a side elevational view illustrating an embodiment of the invention in which no bridge base plate is provided. In accordance with this embodiment, the height and tone adjustment bar(s) 3 rest directly upon the surface of the instrument body 6, thereby providing further improved indirect contact between the string 1 and the instrument body 6.

Thus the invention described in exemplary embodiments above provides a bridge system that is capable of providing improved sustain, increased tonal possibilities, and more full contact between the string, the bridge piece, the bridge plate, and ultimately the instrument's body. The bridge system provides a more solid feeling in the string for the musician in comparison to other designs, and more feedback from the guitar body to the musician. The bridge system of the present design can further provide more range available for setting intonation. The present bridge system can provide the ability to adjust, raise and lower strings smoothly and easily, and a means to raise and lower string height while maintaining a full, solid contact from string to bridge to body of the instrument. The bridge system in certain embodiments eliminates the old bridge height adjustment feet and height adjustment studs which cause sound to be lost. The invention eliminates many rattles and sympathetic vibrations that exist in other designs. The invention provides the ability to change the materials from which the height adjustment bars and bridge pieces are constructed, giving the musician different tones and sustaining combinations to choose from. The bridge system of the invention can be designed to replace current and legacy bridges by using their existing means of attaching the bridge to the body, with little or no drilling of new holes.

While the invention has been particularly shown and described with reference to a preferred embodiment thereof, it will be understood by those skilled in the art that various changes in form and details may be made therein without departing from the spirit and scope of the invention.

The invention claimed is:

1. A bridge system for connection to the instrument body of a stringed instrument, comprising:

a plurality of bridge pieces configured to individually and independently contact a corresponding plurality of strings of said stringed instrument;

a plurality of ramp-shaped height and tone adjustment bars between said plurality of bridge pieces and said instrument body, the bars extending in a longitudinal orientation with respect to the strings in a direction both forward and rearward of the bridge pieces;

a corresponding plurality of adjustment mechanisms that translate the plurality of height and tone adjustment bars independently with respect to the plurality of bridge pieces bridge piece to raise and lower the strings and to provide contact between the plurality of bridge pieces and the instrument body; and a corresponding plurality of adjustment mechanisms that translate the bridge pieces independently along a surface of the ramp-shaped height and tone bars.

2. The bridge system in accordance with claim 1, further comprising a bridge base plate between said plurality of height and tone adjustment bars and said instrument body.

3. The bridge system in accordance with claim 1, wherein at least one of said plurality of adjustment mechanisms comprises a height and tone adjustment bolt for translating the height and tone adjustment bar.

4. The bridge system in accordance with claim 1, wherein at least one of said plurality of adjustment mechanisms comprises a bridge piece adjustment bolt for translating the bridge piece.

5. The bridge system in accordance with claim 1, wherein at least one of said plurality of adjustment mechanisms comprises both a bridge piece adjustment bolt for translating the bridge piece and a height and tone adjustment bolt for translating the height and tone adjustment bar.

6. The bridge system in accordance with claim 1, wherein said height and tone adjustment bars are constructed of metal.

7. The bridge system in accordance with claim 1, wherein said height and tone adjustment bars are constructed of lead.

8. The bridge system in accordance with claim 1, wherein said height and tone adjustment bars are constructed of copper.

9. The bridge system in accordance with claim 1, wherein said height and tone adjustment bars are constructed of graphite.

10. The bridge system in accordance with claim 1, wherein said height and tone adjustment bars are constructed of solid surface material.

11. The bridge system in accordance with claim 1, wherein said height and tone adjustment bars are constructed of thermosetting plastic.

12. The bridge system in accordance with claim 1, wherein said height and tone adjustment bars are constructed of animal bone.

13. The bridge system in accordance with claim 1, wherein said height and tone adjustment bars are constructed of wood.

14. The bridge system in accordance with claim 1, wherein said height and tone adjustment bars are bar is constructed of a polymer.

15. The bridge system in accordance with claim 1, wherein said adjustment mechanisms has a locking mechanism.

* * * * *